US011780051B2

(12) United States Patent
Lehnig

(10) Patent No.: US 11,780,051 B2
(45) Date of Patent: Oct. 10, 2023

(54) METHOD AND APPARATUS FOR ENHANCED BLAST STREAM

(71) Applicant: Cold Jet LLC, Loveland, OH (US)

(72) Inventor: Tony Lehnig, Loveland, OH (US)

(73) Assignee: Cold Jet, LLC, Loveland, OH (US)

( * ) Notice: Subject to any disclaimer, the term of this patent is extended or adjusted under 35 U.S.C. 154(b) by 0 days.

(21) Appl. No.: 17/139,292

(22) Filed: Dec. 31, 2020

(65) Prior Publication Data

US 2021/0197337 A1 Jul. 1, 2021

Related U.S. Application Data

(60) Provisional application No. 62/955,893, filed on Dec. 31, 2019.

(51) Int. Cl.
*B24C 5/04* (2006.01)
*B24C 1/00* (2006.01)

(52) U.S. Cl.
CPC ..... *B24C 1/003* (2013.01); *B24C 5/04* (2013.01)

(58) Field of Classification Search
CPC .. B24C 1/003; B24C 5/04; B24C 5/02; B24C 7/0046; B05B 7/1626; B05B 7/1486; Y02P 70/10
See application file for complete search history.

(56) References Cited

U.S. PATENT DOCUMENTS 1,170,198 A 2/1916 Sweet et al.
2,376,616 A 5/1945 Oechsle et al.
2,665,118 A 1/1954 Olof
2,699,403 A 1/1955 Courts
2,714,563 A 8/1955 Poorman et al.
2,910,812 A 11/1959 Brunner
2,990,653 A 7/1961 Browning
3,033,711 A 5/1962 Harding
3,259,320 A 7/1966 Frey
3,440,082 A 4/1969 Kube
3,463,249 A 8/1969 Browning et al.
3,760,294 A 9/1973 Roberts et al.
3,828,488 A 8/1974 Kendall
3,851,426 A 12/1974 Lemelson
3,882,416 A 5/1975 Borghi et al.
(Continued)

FOREIGN PATENT DOCUMENTS

BE 1011508 A6 10/1999
EP 0414863 A1 3/1991
(Continued)

OTHER PUBLICATIONS

The Fundamentals of Dry Ice Blast Cleaning; http://www.meccrios.com/_articoli/en/The%20Fundamentals%20of%20Dry%20Ice%20Blast%20Cleaning.pdf; Accessed on Mar. 11, 2021; 10 pages.
(Continued)

*Primary Examiner* — Erin F Bergner
(74) *Attorney, Agent, or Firm* — Frost Brown Todd LLP

(57) ABSTRACT

A method and apparatus produce an enhanced blast stream which may be directed at a workpiece. The enhanced blast stream has higher energy allowing the blast stream to remove difficult to remove coatings from substrates. A heated flow is combined with an entrained particle flow and expelled through a nozzle. The heated flow results in more energy being imparted to the coating.

9 Claims, 3 Drawing Sheets

(56) References Cited

U.S. PATENT DOCUMENTS

| | | | |
|---|---|---|---|
| 4,011,099 | A | 3/1977 | Gutsche |
| 4,038,786 | A | 8/1977 | Fong |
| 4,191,556 | A | 3/1980 | Rothblatt |
| 4,389,820 | A | 6/1983 | Fong et al. |
| 4,641,786 | A | 2/1987 | Moore |
| 4,708,534 | A | 11/1987 | Gallant |
| 4,744,181 | A | 5/1988 | Moore et al. |
| 4,765,540 | A | 8/1988 | Yie |
| 4,815,241 | A | 3/1989 | Woodson |
| 4,843,770 | A | 7/1989 | Crane et al. |
| 4,965,968 | A | 10/1990 | Kelsal |
| 5,018,317 | A | 5/1991 | Kiyoshige et al. |
| 5,018,667 | A | 5/1991 | Lloyd |
| 5,050,805 | A | 9/1991 | Lloyd et al. |
| 5,054,249 | A | 10/1991 | Rankin |
| 5,071,289 | A | 12/1991 | Spivak |
| 5,125,979 | A | 6/1992 | Swain et al. |
| 5,188,151 | A | 2/1993 | Young et al. |
| 5,203,794 | A | 4/1993 | Stratford et al. |
| 5,249,426 | A | 10/1993 | Spivak et al. |
| 5,283,985 | A | 2/1994 | Browning |
| 5,288,028 | A | 2/1994 | Spivak et al. |
| 5,301,509 | A | 4/1994 | Lloyd et al. |
| 5,341,608 | A | 8/1994 | Mains, Jr. |
| 5,354,384 | A | 10/1994 | Sneed et al. |
| 5,367,838 | A | 11/1994 | Visaisouk et al. |
| 5,390,450 | A | 2/1995 | Goenka |
| 5,445,553 | A | 8/1995 | Cryer et al. |
| 5,473,903 | A | 12/1995 | Lloyd et al. |
| 5,520,572 | A | 5/1996 | Opel et al. |
| 5,601,478 | A | 2/1997 | Mesher |
| 5,616,067 | A | 4/1997 | Goenka |
| 5,725,154 | A | 3/1998 | Jackson |
| 5,779,523 | A | 7/1998 | Mesher |
| 5,820,447 | A | 10/1998 | Niechcial |
| 5,910,042 | A | 6/1999 | Niechcial |
| 5,910,338 | A | 6/1999 | Donde |
| 5,946,818 | A | 9/1999 | Baxter et al. |
| 5,961,371 | A | 10/1999 | Meynckens et al. |
| 5,989,647 | A | 11/1999 | Remy et al. |
| 6,024,304 | A | 2/2000 | Sawada |
| 6,042,458 | A | 3/2000 | Lehnig et al. |
| 6,174,225 | B1 | 1/2001 | Becker |
| 6,270,394 | B1 | 8/2001 | Visaisouk et al. |
| 6,283,833 | B1 | 9/2001 | Pao et al. |
| 6,346,035 | B1 | 2/2002 | Anderson et al. |
| 6,371,839 | B2 | 4/2002 | Izawa et al. |
| 6,386,949 | B1 | 5/2002 | Hagiwara et al. |
| 6,519,919 | B1 | 2/2003 | Takenouchi et al. |
| 6,524,172 | B1 | 2/2003 | Rivir et al. |
| 6,524,394 | B2 | 2/2003 | Okazawa et al. |
| 6,659,844 | B2 | 12/2003 | Shaw |
| 6,695,679 | B2 | 2/2004 | Anderson et al. |
| 6,695,685 | B2 | 2/2004 | Stratford et al. |
| 6,695,686 | B1 | 2/2004 | Frohlich et al. |
| 6,726,549 | B2 | 4/2004 | Rivir et al. |
| 6,739,529 | B2 | 5/2004 | Linger et al. |
| 6,824,450 | B2 | 11/2004 | Opel |
| 6,863,594 | B2 | 3/2005 | Preising |
| 6,884,386 | B2 | 4/2005 | Saka et al. |
| 6,900,246 | B2 | 5/2005 | List et al. |
| 7,040,130 | B2 | 5/2006 | Liu et al. |
| 7,040,962 | B2 | 5/2006 | Makino et al. |
| 7,041,176 | B2 | 5/2006 | Kruse |
| 7,112,120 | B2 | 9/2006 | Rivir et al. |
| 7,134,946 | B1 | 11/2006 | Jackson |
| 7,220,165 | B2 | 5/2007 | Inagaki et al. |
| 7,261,617 | B1 | 8/2007 | Kim et al. |
| 7,293,570 | B2 | 11/2007 | Jackson |
| 7,451,941 | B2 | 11/2008 | Jackson |
| 7,452,475 | B2 | 11/2008 | Tan et al. |
| 7,484,670 | B2 | 2/2009 | Kipp |
| 7,708,620 | B2 | 5/2010 | Kipp |
| 7,762,869 | B2 | 7/2010 | Yoon |
| 7,901,485 | B2 | 3/2011 | McCutchen |
| 7,950,984 | B2 | 5/2011 | Rivir et al. |
| 7,967,664 | B2 | 6/2011 | Elbing et al. |
| 7,997,110 | B2 | 8/2011 | Carter et al. |
| 8,052,074 | B2 | 11/2011 | Venkatachalapathy et al. |
| 8,187,057 | B2 | 5/2012 | Broecker |
| 8,210,908 | B2 | 7/2012 | Hashish |
| 8,252,130 | B2 | 8/2012 | Oguri et al. |
| 8,277,288 | B2 | 10/2012 | Spivak et al. |
| 8,475,230 | B2 | 7/2013 | Summers et al. |
| 8,500,520 | B2 | 8/2013 | Fowler, III |
| 8,691,014 | B2 | 4/2014 | Vijay |
| 8,869,551 | B2 | 10/2014 | Young et al. |
| 9,095,956 | B2 | 8/2015 | Broecker et al. |
| 9,239,063 | B2 | 1/2016 | Fenton et al. |
| 9,592,586 | B2 | 3/2017 | Lehnig et al. |
| 9,914,142 | B2 | 3/2018 | Quintard et al. |
| 9,931,639 | B2 | 4/2018 | Lehnig |
| 10,081,091 | B2 | 9/2018 | Lee et al. |
| 10,099,344 | B2 | 10/2018 | Sergio et al. |
| 10,186,419 | B2 | 1/2019 | Choi et al. |
| 10,315,862 | B2 | 6/2019 | Mallaley et al. |
| 10,323,539 | B2 | 6/2019 | Bewlay et al. |
| 10,512,949 | B2 | 12/2019 | Cho |
| 10,661,287 | B2 | 5/2020 | Jackson |
| 10,844,881 | B2 | 11/2020 | Fange-Larsen |
| 10,858,740 | B2 | 12/2020 | Möller et al. |
| 2001/0007808 | A1 | 7/2001 | Mishima et al. |
| 2002/0074438 | A1 | 6/2002 | Horigane |
| 2003/0199232 | A1 | 10/2003 | Rivir et al. |
| 2004/0011378 | A1 | 1/2004 | Jackson |
| 2008/0092923 | A1* | 4/2008 | Elbing ..... B24C 5/04 134/115 R |
| 2008/0146432 | A1 | 6/2008 | Hiroyasu et al. |
| 2008/0149047 | A1 | 6/2008 | Becker et al. |
| 2009/0061738 | A1 | 3/2009 | Saka et al. |
| 2009/0093196 | A1 | 4/2009 | Dressman |
| 2012/0291479 | A1 | 11/2012 | Moore et al. |
| 2013/0040538 | A1 | 2/2013 | Scrivani et al. |
| 2013/0106034 | A1 | 5/2013 | Odenthal et al. |
| 2013/0341427 | A1 | 12/2013 | Ukawa et al. |
| 2014/0110510 | A1 | 4/2014 | Rivir et al. |
| 2014/0131484 | A1 | 5/2014 | Gomez et al. |
| 2014/0367493 | A1 | 12/2014 | Gomez |
| 2015/0166350 | A1 | 6/2015 | Fritz et al. |
| 2015/0196921 | A1 | 7/2015 | Lehnig |
| 2015/0375365 | A1 | 12/2015 | Lehnig et al. |
| 2016/0257506 | A1 | 3/2016 | Mallaley et al. |
| 2017/0106500 | A1 | 4/2017 | Mallaley et al. |
| 2018/0306055 | A1 | 10/2018 | Giljohann et al. |
| 2019/0321942 | A1 | 10/2019 | Mallaley et al. |

FOREIGN PATENT DOCUMENTS

| | | | |
|---|---|---|---|
| EP | 1036633 | A2 | 9/2000 |
| EP | 1925360 | A1 | 5/2008 |
| EP | 2681009 | A1 | 1/2014 |
| EP | 2694249 | A1 | 2/2014 |
| EP | 2862673 | A1 | 4/2015 |
| FR | 2596672 | A1 | 10/1987 |
| GB | 2372039 | A | 8/2002 |
| JP | 2011-207663 | A | 10/2011 |
| RU | 125920 | U1 | 3/2013 |
| SU | 667392 | A1 | 6/1979 |
| WO | WO 2005/049239 | A1 | 6/2005 |
| WO | WO 2012/089359 | A1 | 7/2012 |
| WO | WO 2016/136443 | A1 | 9/2016 |

OTHER PUBLICATIONS

Ishii, R., and K. Kawasaki. "Limiting particle streamline in the flow of a gas—particle mixture through an axially symmetric nozzle." *The Physics of Fluids* 25.6 (1982): 959-966.

Peltier III, Donald W. *Performing particle image velocimetry in a supersonic wind tunnel using carbon dioxide as the seed material*. Air Force Inst of Tech Wright-Patterson AFB OH School of Engineering and Management, 2007.

U.S. Appl. No. 61/394,688, filed Oct. 19, 2010.

(56) References Cited

OTHER PUBLICATIONS

U.S. Appl. No. 61/487,837, filed May 19, 2011.
U.S. Appl. No. 61/589,551, filed Jan. 23, 2012.
U.S. Appl. No. 61/592,313, filed Jan. 30, 2012.
U.S. Appl. No. 62/129,483, filed Mar. 6, 2015.
U.S. Appl. No. 62/890,044, filed Aug. 21, 2019.
International Search Report and Written Opinion dated Apr. 21, 2021, for International Application No. PCT/US2020/067643, 16 pages.

* cited by examiner

METHOD AND APPARATUS FOR ENHANCED BLAST STREAM

Particle blast systems utilizing various types of blast media are well known. Systems for entraining cryogenic particles, such as solid carbon dioxide particles, in a transport fluid and for directing the entrained particles toward objects/targets are well known, as are the various component parts associated therewith, such as nozzles, and are shown in U.S. Pat. Nos. 4,744,181, 4,843,770, 5,018,667, 5,050,805, 5,071,289, 5,188,151, 5,249,426, 5,288,028, 5,301,509, 5,473,903, 5,520,572, 6,024,304, 6,042,458, 6,346,035, 6,524,172, 6,695,679, 6,695,685, 6,726,549, 6,739,529, 6,824,450, 7,112,120, 7,950,984, 8,187,057, 8,277,288, 8,869,551, 9,095,956, 9,592,586, 9,931,639 and 10,315,862 all of which are incorporated herein in their entirety by reference.

Additionally, U.S. patent application Ser. No. 11/853,194, filed Sep. 11, 2007, for Particle Blast System With Synchronized Feeder and Particle Generator US Pub. No. 2009/0093196; U.S. Provisional Patent Application Ser. No. 61/589,551 filed Jan. 23, 2012, for Method And Apparatus For Sizing Carbon Dioxide Particles; U.S. Provisional Patent Application Ser. No. 61/592,313 filed Jan. 30, 2012, for Method And Apparatus For Dispensing Carbon Dioxide Particles; U.S. patent application Ser. No. 13/475,454, filed May 18, 2012, for Method And Apparatus For Forming Carbon Dioxide Pellets; U.S. patent application Ser. No. 14/062,118 filed Oct. 24, 2013 for Apparatus Including At Least An Impeller Or Diverter And For Dispensing Carbon Dioxide Particles And Method Of Use US Pub. No. 2014/0110510; U.S. patent application Ser. No. 14/516,125, filed Oct. 16, 2014, for Method And Apparatus For Forming Solid Carbon Dioxide US Pub. No. 2015/0166350; U.S. patent application Ser. No. 15/297,967, filed Oct. 19, 2016, for Blast Media Comminutor US Pub. No. 2017/0106500; U.S. application Ser. No. 15/961,321, filed Apr. 24, 2018 for Particle Blast Apparatus; and U.S. Provisional Patent Application Ser. No. 62/890,044, filed Aug. 21, 2019, for Particle Blast Apparatus and Method, are all incorporated herein in their entirety by reference.

BACKGROUND

Also well-known are particle blast apparatuses which entrain non-cryogenic blast media, such as but not limited to abrasive blast media. Examples of abrasive blast media include, without limitation, silicon carbide, aluminum oxide, glass beads, crushed glass and plastic. Abrasive blast media can be more aggressive than dry ice media, and its use preferable in some situations.

Mixed media blasting is also known, in which more than one type of media is entrained within a flow which is directed toward a target. In one form of mixed media blasting, dry ice particles and abrasive media are entrained in a single flow and directed toward a target.

BRIEF DESCRIPTION OF THE DRAWINGS

The accompanying drawings illustrate embodiments which serve to explain the principles of the present innovation.

DESCRIPTION

Figure 1:
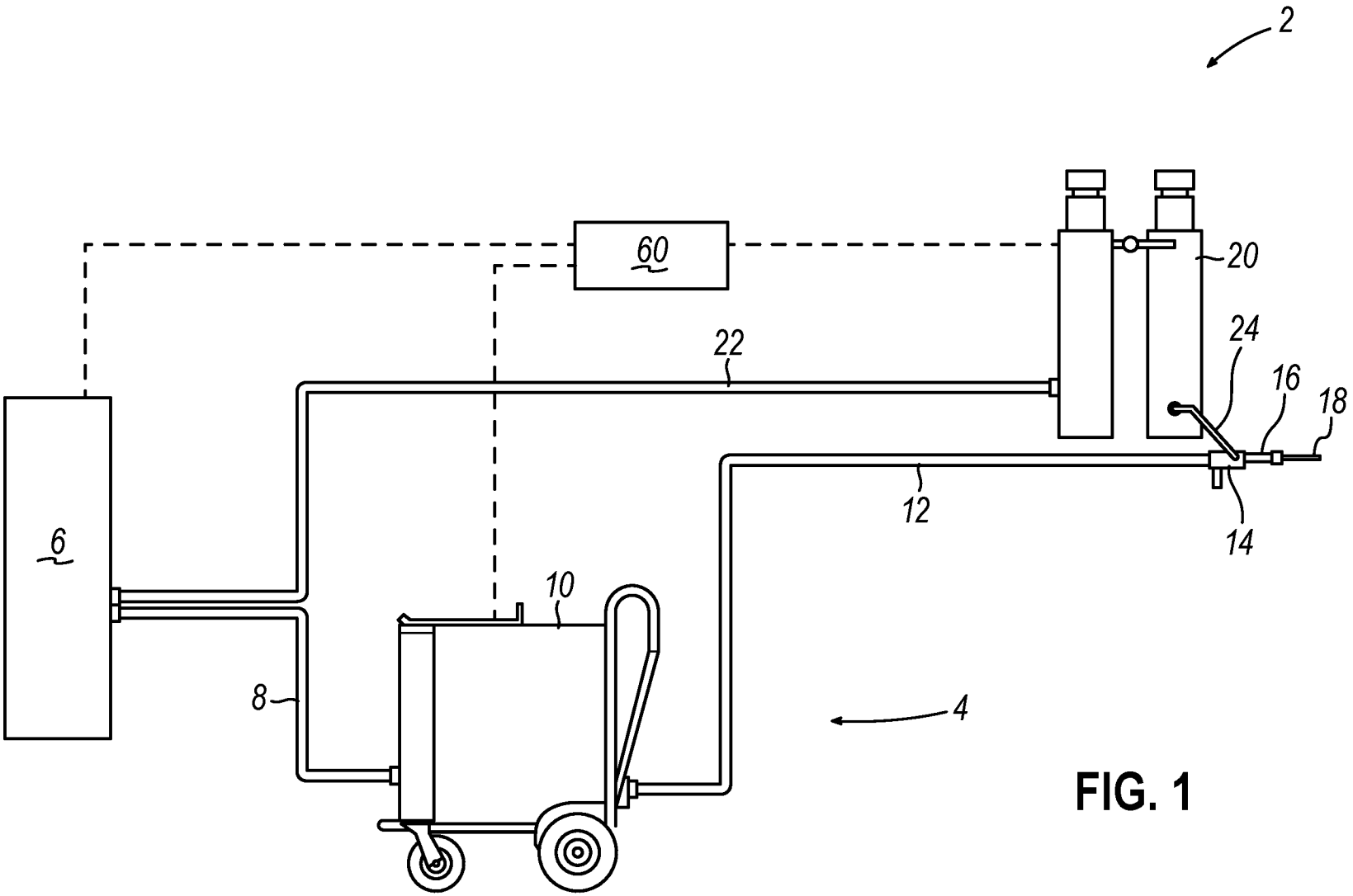
FIG. 1 diagrammatically illustrates a particle blast system configured in accordance with one or more teachings of the present innovation.

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, one or more embodiments constructed according to the teachings of the present innovation are described.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference.

Many factors affect the ultimate performance of the flow of entrained particles exiting the blast nozzle of the particle blast system and impacting a target. In accordance with the teachings of the present innovation, the kinetic energy of the particles at impact on the target and the temperature of the flow may be considered as affecting the ultimate performance. The present innovation provides an apparatus and a method for achieving particle kinetic energy at the workpiece and/or flow temperature at the workpiece which provides the desired performance.

The present innovation utilizes the addition of energy to the entrained particle flow which increases the particle kinetic energy at the workpiece and/or which increases the flow temperature at the workpiece. In embodiments disclosed herein, the addition of energy is achieved by providing a flow of heated fluid, such as a gas, and combining the heated fluid flow with the flow of entrained particles. In one embodiment, the heated fluid is combined with the entrained particle flow proximal the blast nozzle. In an embodiment in which the blast nozzle is a supersonic nozzle, the heated fluid may be combined with the entrained particle flow proximal the minimum throat area of the converging—diverging flow path, and may be combined immediately upstream of where the combined flow reaches Mach 1.

FIG. 1 diagrammatically illustrates particle blast system 2 which includes particle blast apparatus 4. Particle blast apparatus 4 is connectable to source 6 of compressed fluid which is delivered through hose 8 to particle feeder (not shown) disposed within unit 10. As is known, the particle feeder entrains blast media particles, which are carbon dioxide particles in the embodiment depicted, it receives from a source of blast media particles into the flow of transport fluid and the entrained particle flow flows through an entrained flow passageway defined by delivery hose 12 to applicator 14 and flows out blast nozzle 18.

Compressed fluid from source 6 may be any suitable transport fluid, such as air, at any suitable pressure, such as 40 psig up to 300 psig. Transport fluid, at least after it leaves source 6, is flowing fluid which has sufficient kinetic energy to convey the particles entrained therein.

In the embodiment depicted, blast nozzle 18 is a supersonic nozzle. Although blast nozzle 18 is depicted as a supersonic nozzle, the present innovation may be used with sonic and subsonic nozzles.

In the embodiment depicted, injector 16 is interposed between applicator 14 and nozzle 18. Injector 16 may be configured as a separate component or be an integral part of applicator 14.

System 2 includes heater 20 which receives the flow of compressed fluid from source 6 through hose 22, adds energy to the flow resulting in an increase in temperature, and delivers the higher energy fluid, also referred to herein as heated flow, to injector 16 through a heated fluid passageway defined by hose 24. The temperature of the heated flow when it reaches injector 16 may be any suitable temperature, for example, 750° Fahrenheit. The temperature may be within a range of temperatures from above ambient up to and including 750° Fahrenheit. Depending on the desired performance and the target, the temperature of the heated flow may be higher than 750° Fahrenheit.

Heater 20 may be disposed in any suitable location. In FIG. 1, heater 20 is diagrammatically illustrated disposed close to injector 16 to minimize heat loss from the heated flow between heater 20 and injector 16. A dryer (not illustrated) to remove moisture from the compressed fluid may be included, disposed in any suitable location. A dryer could be an integral part of source 6 or heater 20.

Figure 2:
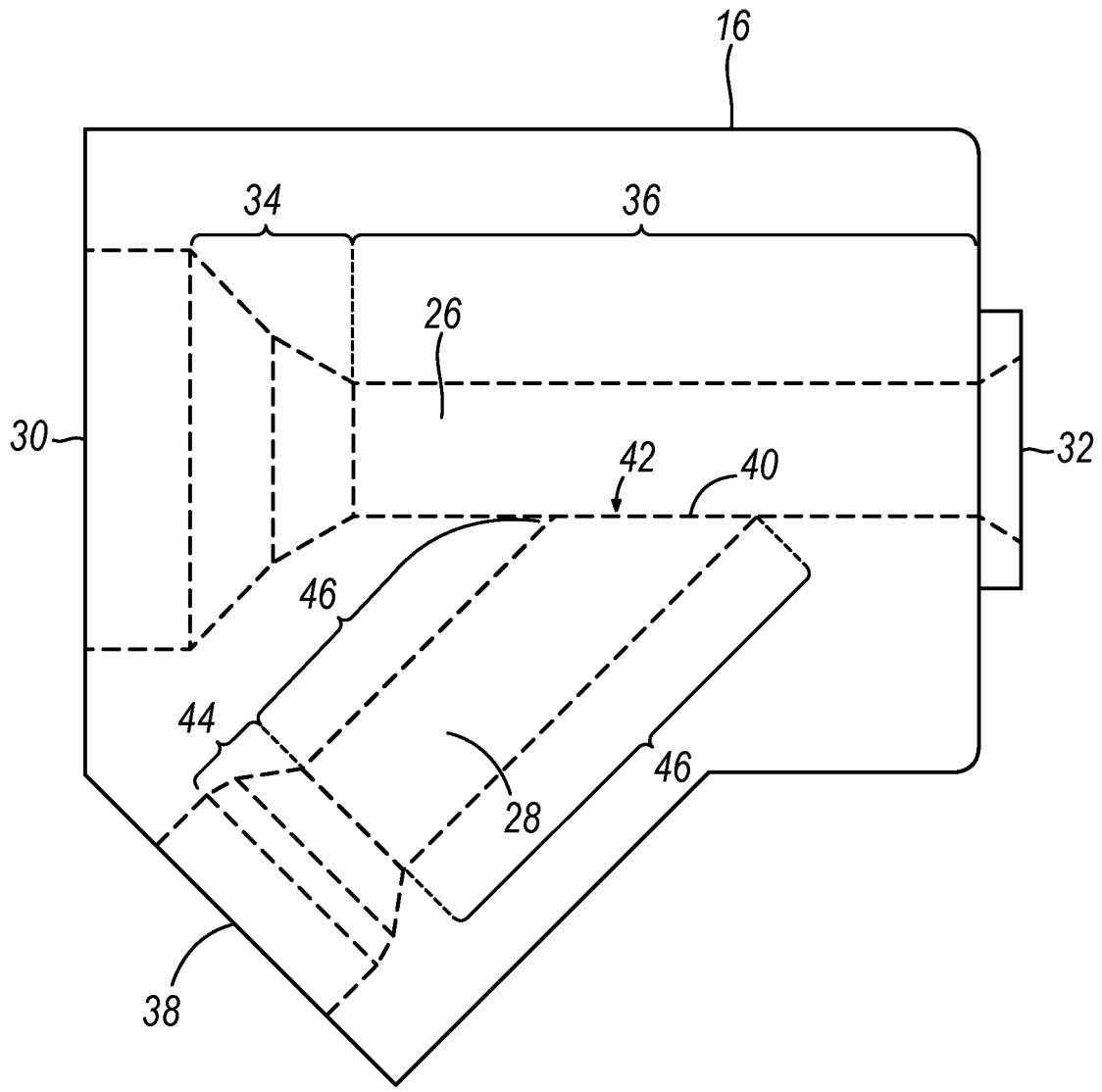
FIG. 2 diagrammatically illustrates an injector for adding energy to the entrained particle flow.

Referring to FIG. 2, an embodiment of injector 16 is diagrammatically illustrated. As mentioned above, although injector 16 is illustrated as a separate component, the features and function of injector 16 may be an integral part of applicator 14. Injector 16 comprises first flow path 26 (also referred to as first flow passageway) and second flow path 28 (also referred to as second flow passageway). First flow path 26 includes inlet 30 and outlet 32, with fluid flow within first flow path 26 being from inlet 30 to outlet 32. Blast nozzle 18 (not shown in FIG. 2) is connected in fluid communication with outlet 32. In the embodiment depicted, first flow path 26 of injector 16 comprises first portion 34 in fluid communication with inlet 30 followed by second portion 36 in fluid communication with outlet 32. In the embodiment depicted, first portion 34 is configured as a converging portion, which functions as the converging portion necessary to create supersonic flow downstream. In an alternate embodiment, the converging portion illustrated as part of first portion 34 may be disposed upstream of inlet 30, with inlet 30 being directly in fluid communication with second portion 36.

Second portion 36 comprises a generally constant cross-sectional area to a converging cross-sectional area along its length. Second portion 36 may have a portion of generally constant cross-sectional area leading to a portion of converging cross-sectional area. Second portion 36, when part of a supersonic converging diverging pathway, is configured for the operating conditions of system 2 with its minimum cross-sectional area located near outlet 32, downstream of the junction of first flow path 26 and second flow path 28 (described below), such that location of Mach 1 in supersonic flow occurs downstream of the junction. The supersonic expansion of the flow after reaching Mach 1 primarily occurs in blast nozzle 18.

Second flow path 28 comprises inlet 38 and outlet 40, with fluid flow through second flow path 28 being from inlet 38 to outlet 40. Outlet 40 places second flow path 28 in fluid communication with first flow path 26 at junction area 42. In the embodiment depicted, second flow path 28 comprises first portion 44 in fluid communication with inlet 38 followed by second portion 46 in fluid communication with outlet 40 at junction area 42. In the embodiment depicted, first portion 44 is configured as a converging portion, which functions to accelerate flow within second flow path 28. In an alternate embodiment, the converging portion illustrated as part of first portion 44 may be disposed upstream of inlet 38, with inlet 38 being directly in fluid communication with second portion 46.

Second portion 46 comprises a generally constant cross-sectional area to a converging cross-sectional area along its length. Second portion 46 may have a portion of generally constant cross-sectional area leading to a portion of converging cross-sectional area. In the supersonic embodiment, downstream of junction area 42, the combined flow of first flow path 26 and second flow path 28 will reach Mach 1. Thus, second flow path is configured not to produce Mach 1 in the flow therethrough.

In the embodiment depicted, hose 24 is connected to inlet 30 such that the heated flow flows through first flow path 26. The flow of transport gas with entrained particles is delivered to flow path 28 through inlet 38. This configuration avoids energy loss that would result in turning the heated flow through the joining angle (the angle between first flow path 26 and second flow path 28). The joining angle should be as small as possible to minimize losses through the angle. Alternately, the flow of transport gas with entrained particles could be delivered to flow path 26 through inlet 30, and the heated flow delivered to flow path 28 through inlet 38, with the flow paths being respectively configured for this arrangement of flow.

In operation, according to one embodiment the heated flow is directed through first flow path 26, reaching second portion 36 after its speed is increased as a result of being converged either by first portion 34 or upstream thereof. The entrained particle flow is directed through second flow path 28, reaching second portion 46 after its speed is increased as a result of being converged either by first portion 44 or upstream thereof. The heated flow and entrained particle flow combine proximal junction area 42, and the combined flow reaches Mach 1 downstream of junction area 42 as a result of the configuration of the flow paths of injector 16 which is configured to do so for the design attributes of the flow (e.g., pressure, temperature, density).

The combined flow, comprised of the heated flow and the entrained particle flow, flows through and out blast nozzle 18 to be directed toward a target workpiece. The energy added to the entrained particle flow, in the embodiment depicted as a result of the combination with the heated flow, produces supersonic entrained particle flow with much higher energy than without the addition of the energy. This higher energy may be manifested as a higher speed of the gas flow, a higher temperature of the flow and/or higher kinetic energy of the entrained particles. With a higher speed of the gas flow, the entrained particles have a higher speed.

The resultant flow from a system according to the present innovation is capable of removing difficult coatings from substrates, such as epoxy and enamel.

The cryogenic particles flowing entrained in the lower transport fluid are not exposed to the temperature of the heated flow until the flow is combined minimizing sublimation of the cryogenic particles due to the thermal energy of the heated flow. In the supersonic embodiment depicted, this occurs immediately upstream of the Mach 1 sonic plane in first flow path 26. Once combined, the flow is immediately accelerated above Mach 1.

Figure 3:
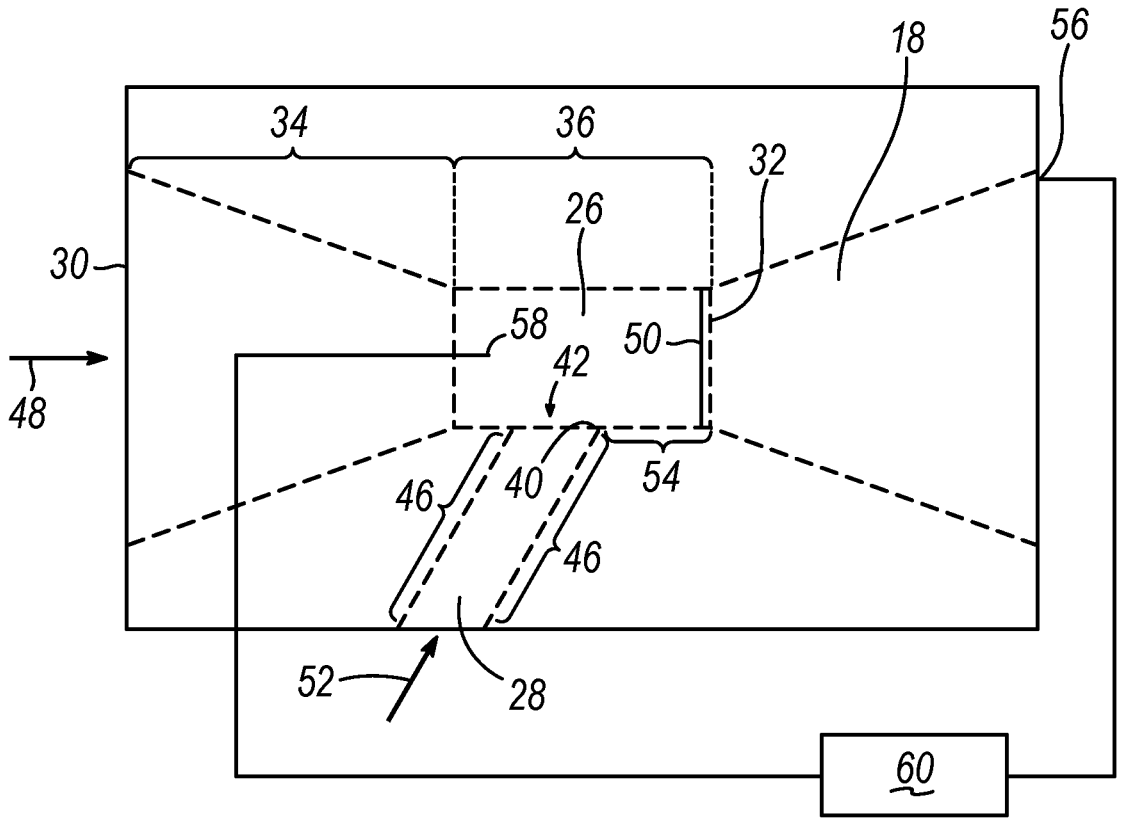
FIG. 3 diagrammatically illustrates a converging diverging configuration for review of the fluid dynamics of flow through a first flow path and a second flow path in communication with the first flow path according to aspects of teachings of the present innovation.

Referring now to FIG. 3, which is a diagrammatic illustration of a converging diverging configuration for reviewing the fluid dynamics of the flows. As indicated above, in the embodiment depicted, heated flow, indicated by arrow 48, is accelerated by the convergence of first portion 34 and enters second portion 36. The cross-sectional area of second portion 36 is as may be necessary for the desired velocity of the heated flow with the desired retainment of heat. While second portion 36 may continue convergence prior to the joining of the entrained particle flow, it is noted that increasing the velocity of the heated flow by convergence causes a corresponding decrease in temperature. Mach 1 occurs downstream of junction area 42 at the sonic plane 50 (diagrammatically illustrating normal shock wave). Sonic plane 50 is the junction point for nozzles of various design characteristics which may yield supersonic exit flow as indicated, or may yield sonic flow. In one embodiment, sonic plane 50 is coincident with outlet 32.

Entrained particle flow, indicated by arrow 52, has been accelerated by convergence upstream of second portion 46. The cross-sectional area of second portion 46 may achieve the desired reduction in static wall pressure relative to the supplied total pressure and associated mass flow of the entrained particle flow. The static wall pressure at outlet 40/junction area 42 is lower than the total pressure of the entrained particle flow entering second portion 36.

Joining region 54 is the region in which the two flows join, and the length of joining region 54 can approach zero if the exiting cross-sectional area and corresponding internal/exit pressure are able to provide choked sonic flow condition at outlet 32.

Various pressures and flows may be present, depending on the design. For example, the combined flow may be 60 to 65 CFM at 80 PSI. In another embodiment, the heated flow may be 170 CFM at 150 PSI. The flow characteristics may fall therebetween.

The relative flows of the heated flow and the entrained particle flow may be as are suitable for the design and operating parameters of the system. In one embodiment, the heated flow was about 75% and the entrained particle flow was about 25%, of the total flow.

The temperature of the flow may be monitored to optimize the temperature at the blast nozzle exit. For example, temperature may be monitored at 56 at the exit of nozzle 18 as well as may be monitored upstream of sonic plane 50, such as at 58 by processing system 60. Processing system 60, which may be microprocessor based or be of any suitable configuration, can be configured to control the temperature and flow rate of the heated flow as well as the mass flow, particle size and flow rate of the entrained particle flow. (The temperatures being monitored by processing system 60 is not illustrated in FIG. 1.)

One aspect of the present innovation is the ability to keep the flow above its dew point temperature.

The present innovation and the embodiments described transport the cryogenic particles in an entrained particle flow separate from the flow of the heated flow, maintaining the entrained particle flow unaffected by the heat of the heated flow until the two flows are combined in the injector just before the throat of the combined flow path and the exit from the blast nozzle.

Applicator 14 may comprise control elements, which may provide inputs or signals to processing system 60, allowing the operator to control the heat in the heated flow, such as by non-limiting examples, whether by designating target sensed temperatures at 56, 58, or by setting specific volume of cryogenic particles, particle mass flow or relative flows between the heated flow and the entrained particle flow.

In accordance with various aspects of the disclosure, an element, or any portion of an element, or any combination of elements may be implemented with a "processing system" that includes one or more physical devices comprising processors. Non-limiting examples of processors include microprocessors, microcontrollers, digital signal processors (DSPs), field programmable gate arrays (FPGAs), programmable logic devices (PLDs), programmable logic controllers (PLCs), state machines, gated logic, discrete hardware circuits, and other suitable hardware configured to perform the various functionality described throughout this disclosure. One or more processors in the processing system may execute processor-executable instructions. A processing system that executes instructions to effect a result is a processing system which is configured to perform tasks causing the result, such as by providing instructions to one or more components of the processing system which would cause those components to perform acts which, either on their own or in combination with other acts performed by other components of the processing system would cause the result. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise. The software may reside on a computer-readable medium. The computer-readable medium may be a non-transitory computer-readable medium. Computer-readable medium includes, by way of example, a magnetic storage device (e.g., hard disk, floppy disk, magnetic strip), an optical disk (e.g., compact disk (CD), digital versatile disk (DVD)), a smart card, a flash memory device (e.g., card, stick, key drive), random access memory (RAM), read only memory (ROM), programmable ROM (PROM), erasable PROM (EPROM), electrically erasable PROM (EEPROM), a register, a removable disk, and any other suitable medium for storing software and/or instructions that may be accessed and read by a computer. The computer-readable medium may be resident in the processing system, external to the processing system, or distributed across multiple entities including the processing system. The computer-readable medium may be embodied in a computer-program product. By way of example, a computer-program product may include a computer-readable medium in packaging materials. Those skilled in the art will recognize how best to implement the described functionality presented throughout this disclosure depending on the particular application and the overall design constraints imposed on the overall system.

Explicit Definitions

"Based on" means that something is determined at least in part by the thing that it is indicated as being "based on." When something is completely determined by a thing, it will be described as being "based exclusively on" the thing.

"Processor" means devices which can be configured to perform the various functionality set forth in this disclosure, either individually or in combination with other devices. Examples of "processors" include microprocessors, microcontrollers, digital signal processors (DSPs), field programmable gate arrays (FPGAs), programmable logic devices (PLDs), programmable logic controllers (PLCs), state machines, gated logic, and discrete hardware circuits. The phrase "processing system" is used to refer to one or more processors, which may be included in a single device, or distributed among multiple physical devices.

A statement that a processing system is "configured" to perform one or more acts means that the processing system includes data (which may include instructions) which can be used in performing the specific acts the processing system is "configured" to do. For example, in the case of a computer (a type of "processing system") installing Microsoft WORD on a computer "configures" that computer to function as a word processor, which it does using the instructions for Microsoft WORD in combination with other inputs, such as an operating system, and various peripherals (e.g., a keyboard, monitor, etc. . . . ).

The foregoing description of one or more embodiments of the innovation has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the innovation and its practical application to thereby enable one of ordinary skill in the art to best utilize the innovation in various embodiments and with various modifications as are suited to the particular use contemplated. Although only a limited number of embodiments of the innovation is explained in detail, it is to be understood that the innovation is not limited in its scope to the details of construction and arrangement of components set forth in the preceding description or illustrated in the drawings. The innovation is capable of other embodiments and of being practiced or carried out in various ways. Also, specific terminology was used for the sake of clarity. It is to be understood that each specific term includes all technical equivalents which operate in a similar manner to accomplish a similar purpose. It is intended that the scope of the invention be defined by the claims submitted herewith.

The invention claimed is:

1. A particle blast system configured to expel a stream of entrained particles from a blast nozzle while the particle blast system is operating within its operating parameters, the particle blast system comprising:

a. a source of heated fluid;

b. a source of transport fluid;

c. a particle feeder connected to the source of transport fluid, the particle feeder configured to entrain particles into a flow of the transport fluid flowing from the source of transport fluid thereby creating an entrained particle flow;

d. an injector comprising:

i. a first flow passageway comprising a first flow passageway inlet and a first flow passageway outlet wherein the first flow passageway comprises (a) a first portion in fluid communication with the first flow passageway inlet; and (b) a second portion in fluid communication with the first flow passageway outlet, the second portion comprising a length extending from the first portion to the first flow passageway outlet, the second portion comprising a generally constant to converging cross-sectional area along its length; and ii. a second flow passageway comprising a second flow passageway inlet and a second flow passageway outlet, the second portion comprising a junction area, located upstream of the first flow passageway outlet, at which the second flow passageway is in fluid communication with the first flow passageway via the second flow passageway outlet;

e. an entrained flow passageway in fluid communication with the second flow passageway inlet and configured to deliver the entrained particle flow from the particle feeder to the second flow passageway; and f. a heated fluid passageway which places the source of heated fluid in fluid communication with the first flow passageway inlet.

2. The particle blast system of claim 1, wherein the first portion comprises a converging portion.

3. The particle blast system of claim 1, wherein the first flow passageway is configured to produce sonic flow in the first flow passageway downstream of the junction area when the particle blast system is operating within its operating parameters.

4. The particle blast system of claim 3, wherein the blast nozzle is in fluid communication with the first flow passageway outlet, the blast nozzle being configured for supersonic expansion of flow therein.

5. The particle blast system of claim 1, wherein the second flow passageway comprises a third portion, the third portion comprising converging portion.

6. The particle blast system of claim 5, wherein the second flow passageway comprises a fourth portion downstream of the third portion, the fourth portion comprising a portion of constant cross-sectional area leading to a portion of converging cross-sectional area.

7. The particle blast system of claim 1, wherein the particles comprise cryogenic particles.

8. The particle blast system of claim 1, wherein the first flow passageway is straight between the first flow passageway inlet to the first flow passageway outlet.

9. The particle blast system of claim 1, wherein when the particle blast system is operating within its operating parameters, the static wall pressure of the heated fluid flowing through the first flow passageway at the junction area is lower than the total pressure of the entrained particle flow flowing through the second flow passageway.

* * * * *